United States Patent [19]

Selberg et al.

[11] Patent Number: 4,613,133

[45] Date of Patent: Sep. 23, 1986

[54] GOLF PRACTICE DRIVING DEVICE

[75] Inventors: Roberto B. O. Selberg, Täby; Hakan Kronogard, Lund; John Cockin, Nacka, all of Sweden

[73] Assignee: M.A. Golf Training International AB, Malmö , Sweden

[21] Appl. No.: 604,625

[22] PCT Filed: Aug. 23, 1983

[86] PCT No.: PCT/SE83/00295

§ 371 Date: Apr. 19, 1984

§ 102(e) Date: Apr. 19, 1984

[87] PCT Pub. No.: WO84/00696

PCT Pub. Date: Mar. 1, 1984

[30] Foreign Application Priority Data

Aug. 23, 1982 [SE] Sweden ..... 8201133

[51] Int. Cl.[4] ..... A63B 69/36

[52] U.S. Cl. ..... 273/195 B

[58] Field of Search ..... 273/176 H, 195 B, 195 R, 273/195 A, 183 A; 434/252, 196, 197 R, 197 A, 198

[56] References Cited

U.S. PATENT DOCUMENTS

| | | | |
|---|---|---|---|
| 2,334,540 | 11/1943 | Buffham | 273/176 H |
| 2,879,996 | 3/1959 | Lederer | 273/195 B X |
| 2,937,875 | 5/1960 | Mason et al. | 273/195 B |
| 3,693,979 | 9/1972 | Koett | 273/195 B |
| 3,869,127 | 3/1975 | Kohori | 273/195 B |

*Primary Examiner*—George J. Marlo

*Attorney, Agent, or Firm*—Burns, Doane, Swecker & Mathis

[57] ABSTRACT

Driving device for golf practice, comprising a platform (43) having a suitable upper surface for the golf stroke, the platform (43) being adjustable to incline in any direction to simulate play in upward slope, downward slope or the like, characterized by a centrally positioned downwardly directed pillar (61) arranged below the platform (43), said pillar being vertically displaceable and rotatably arranged in a tube (57) which is fixed part of a plate (55) intended to rest on the ground or other support, by support means (53) imparting stability to the platform (43) when in a lowered position, and by a lifting device (83, 85, 91, 93, 95), by means of which the platform (43) can be raised to an upper position and rotated thereat to the desired orientation and then again lowered to stable lowered position.

6 Claims, 5 Drawing Figures

GOLF PRACTICE DRIVING DEVICE

TECHNICAL FIELD

The present invention relates to a driving device for golf practice, particularly for so-called driving ranges, and the device comprises a platform having a suitable upper surface for carrying a golf ball, for example a carpet, and the platform can be inclined in any desired direction.

An essential aspect of the everyday life of a golf player is the systematic training which often takes place in connection with a practice field, so-called driving range. At such practice field there are usually at one end thereof lined up so-called driving carpets, from which the golf players make their drives. However, in play under realistic conditions on a golf course quite varying playing conditions are encountered in that the ball has to be played in upward slpe, downward slope and the like, which calls for special techniques. Today's practice fields for golf play are therefore incomplete in that at the conventional driving sites one cannot simulate the situations arising in real play out on the course.

Therefore, the present invention has for its purpose to provide a driving device wherein the play platform can be adjusted to incline in different directions. Another purpose of the invention is to provide such driving device wherein the driving support or platform can be oriented in the desired direction in a simple manner and without exertion of large forces.

SUMMARY OF THE INVENTION

Starting from a driving device having an inclined platform there is according to the invention for these and other objects provided a construction which below the platform is provided with a centrally positioned downwardly directed pillar which is vertically displaceable and rotatably arranged in a guide member or tube which is fixed part of a fixture or plate intended to rest on the ground or other support. Moreover, the device is provided with support means by which stability is imparted to the platform when in a lowered position. Finally, the device according to the invention is provided with lifting means by which the platform can be raised to an upper position and rotated thereat to the desired orientation and then again lowered to a stable lowered position. The driving device is then ready for use in golf training.

In a preferred embodiment of the driving device according to the invention the lifting means comprise an outwardly and downwardly pivotable lifting member, the outward movement of which imparts raising of the platform so that the pillar moves upwardly in the tube, a locking member being provided to hold the pillar and thus the platform in its upper position.

According to another preferred feature of the device of the invention a horizontal manoeuvring axle is arranged at the lower side of the platform which carries lifting member and the rotation of which imparts raising or lowering of the said lower side. Said lifting member is preferably arranged to be operated by means of a control stick positioned at one side of the platform.

Moreover, the driving device of the invention may comprise at least one retractable support member arranged at the lower side of the platform. The manoeuvring axle is preferably provided with members which are arranged to move the support member to its outward position when the lifting member is moved outwardly. It is furthermore preferred that the driving device of the invention comprises means for returning the support member to retracted position on returning the lifting member.

EXAMPLE

The invention will in the following be described further in connection to the appended drawings showing a particularly preferred embodiment of the device of the present invention. In the drawing.

Figure 2:
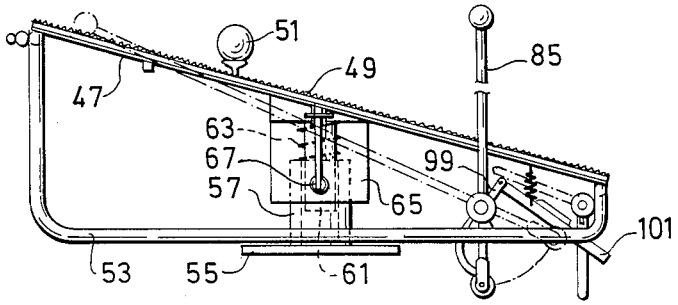
FIG. 2 shows a side view of the same device.
Figure 3:
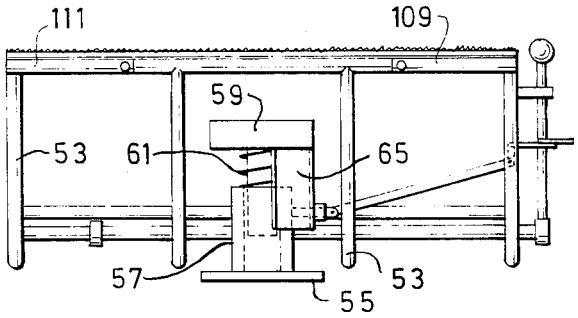
FIG. 3 shows an end view of the same device.

The driving device generally indicated by 41 includes a platform 43 which is supported on a metal frame 45 of a suitable design. The platform consists of a plate 47, suitably of wood, carrying a carpet 49 of a conventional type. In FIG. 2 the device is shown diagrammatically arranged for play in upward slope with a golf ball 51 positioned for a stroke.

The platform 43 is supported by support members 53, suitably made of metal tubing. On the lower side the device according to the invention is provided with a central support plate 55 which in the middle carries an upwardly extending central tube 57. Support plate 55 is intended to rest on the ground or other suitable support in connection with the adjustment of the platform to the desired position.

Figure 5:
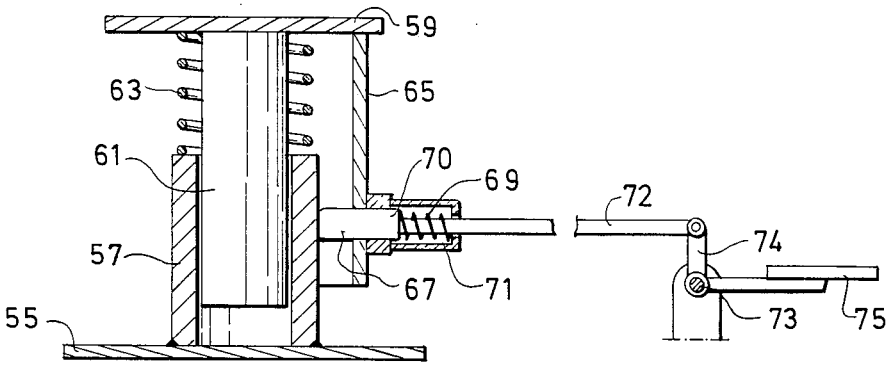
FIG. 5 shows on a larger scale a detail taken along line B—B in FIG. 1.

On the lower side of plate 47 there is attached, in a manner not further shown in the figure, a central plate 59 provided with a downwardly extending pillar 61 designed to be movable from above within the central tube 57 arranged on the support plate 55. A compression spring 63 is arranged about the downwardly extending pillar 61 for a purpose to be further explained below. Moreover, plate 59 carries a downwardly directed fastening member 65 for a locking member 67 which is intended to maintain the platform in a raised position resting on the central support plate 55. Locking member 67 extends through a sleeve 71 attached to the fastening member 65. The bar-shaped locking member 67 is provided with a stop 70 within sleeve 71 which cooperates with a pressure spring 69 arranged within the sleeve, locking member 67 being biassed to move in a leftward direction as seen in FIG. 5. At the outer end locking member 67 is pivotally connected to an angle iron 74 which is pivotable at 73 and the outer end of which carries a pedal 75.

Figure 1:
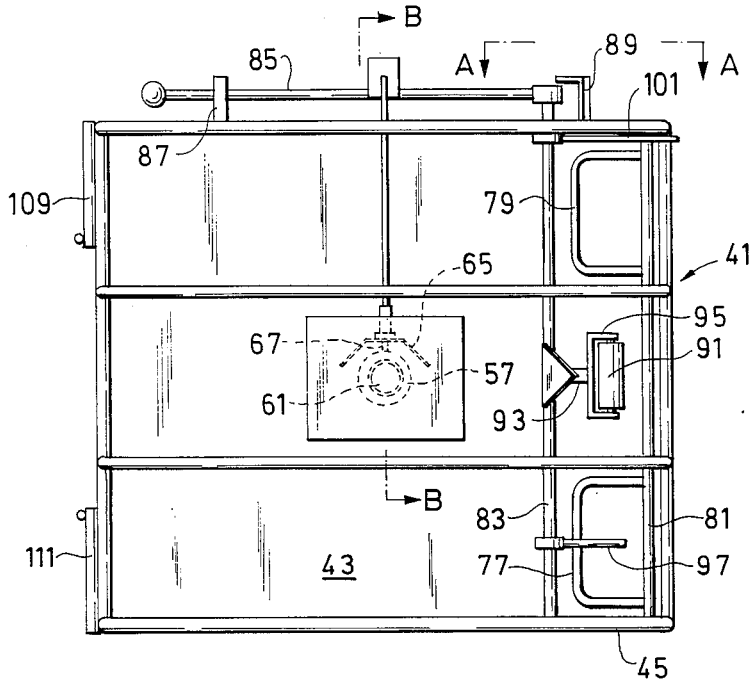
FIG. 1 shows a plan view from below of the driving device.

As is further clear from FIGS. 1 and 2 the device of the invention is also provided with retractable support clamps 77, 79, which are rigidly attached to a rotatable axle 81, said axle being supported in the metal frame 45 in a suitable manner.

The device according to the invention is moreover provided with a manoeuvring axle 83 carrying at its outer end a stick 85 and supporting in mid position under the platform a support roller 91 by means of a leg 93 and a yoke 95 attached to the axle, the rotatably roller 91 being rotatably mounted between the shanks thereof.

Stick 85 can be moved between a lower position wherein it rests on a support 87 attached on the metal frame, and its opposite extreme position is limited by a limit stop 89 positioned at the other end of the platform. Moreover, manoevring axle 83 carries at its inner end a locking member 97 for a purpose to be explained further below.

Manoeuvring axle 83 cooperates via an arm 99 with a slide member 101 which is provided with a cam 103 and which by means of a spring 105 is biassed to engagement with the rotatable axle 81. The latter is provided with a stop 107 cooperating with cam 103.

Finally, the device according to the invention is provided on its right side with extensible support legs 109, 111, whereby the inclination of platform 43 can be further increased.

The function of the device just described is briefly the following. Starting from the position shown in FIG. 1 corresponding to the position of FIG. 2 shown with dashed lines, stick 85 is lifted to the position shown in FIG. 2 with full lines, the support roller 91 being lowered causing lifting of the right side of the platform as seen in FIG. 2. Under the influence of spring 63 this will cause support plate 55 with a pending central tube 57 to move downward so that the upper side of tube 57 will come in a position below locking member 67. This will cause locking member 67 to move inwardly above the upper end of tube 57 under the influence of spring 69, the support plate 55 being locked in extended position.

Figure 4:
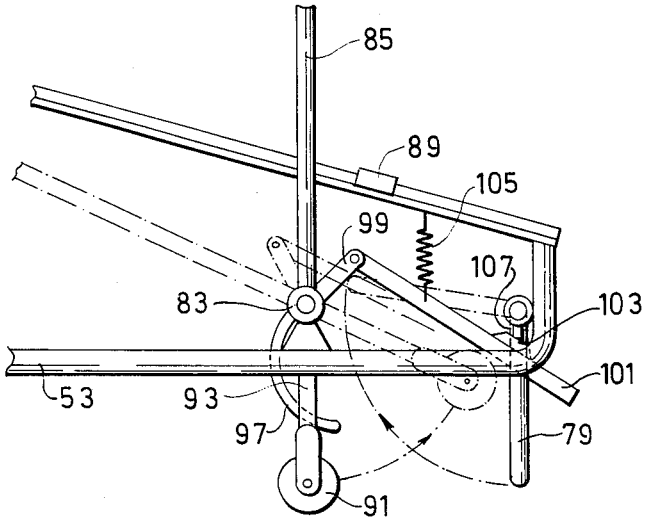
FIG. 4 shows on a larger scale a detail taken along line A—A of FIG. 1.

In connection with the lifting of stick 85 support clamps 77, 79 have moved downwardly by cooperation between cam 103 and stop 107 (FIG. 4) to the position shown in FIG. 4 with full lines. It is further assumed that stick 85 is moved to the right as seen in FIG. 4 all the way up to limit stop 89. This will cause cam 103 on slide member 101 to move past stop 107 which is arranged on the pivotable axle 81, whereby on moving stick 85 to the position shown in FIG. 4 with dashed lines again under the influence of cam 103 and its cooperation with stop 107 support clamps 77, 79 will be returned to retracted position. Support clamps 77, 79 are maintained in this retracted position by locking member 97 placed on the manoeuvring axle 83, the locking member 97 having taken the position shown with solid lines in accordance with FIG. 4.

Now with the central support plate 55 in extended and locked position and stick 85 returned to the position shown in FIG. 1 the platform can be easily rotated about its centre and adjusted in the desired direction for practising shots of a certain type, i.e. upward slope, downward slope or other desired inclined position. After rotating the platform to the desired position locking member 67 is now released by depressing pedal 75 (FIG. 5), the central support plate 55 moving upwardly under the influence of the gravity of the device so that support members 53 will come into engagement with the ground. The platform is then ready for practice in the desired position.

If, however, when the movement of manoeuvring stick 85 is interrupted at the position shown with full lines in FIG. 4 support clamps 77, 79 will not be returned to retracted position shown in FIG. 1, whereby the platform will take essentially horizontal position. In this manner practising can take place with the platform in normal position, i.e. horizontal position.

If on the other hand even higher inclination than that illustrated in FIG. 2 will be desired the extra extensible support legs 109, 111 placed at the right side of the platform can be activated with support plate 55 in extended position, extra inclination being provided.

The device described may, of course, be modified, for example by having the central support plate 55 with tube 57 change place with plate 59 together with pillar 61, spring 63 and locking member 65.

We claim:

1. A golf practice device comprising:

a platform having an upper surface covered with a carpet, the platform being adjustable to be inclined in any direction in order to simulate play in an upward slope, downward slope or slope in the lateral directions;

a bearing support connected to said platform, the platform being rotatably arranged relative said bearing support for rotation relative thereto around a vertical axis;

a frame, the platform being supported by said frame surrounding the platform at a rim portion thereof in order to impart stability to the platform and to support the platform on the ground;

a lifting device for lifting the platform from the ground and relative the bearing support, so that the platform, when the lifting device is activated, may be raised from the ground to be freely rotatable in any direction around said vertical axis, and the platform, when the lifting device is deactivated, may be lowered to be firmly supported on the ground and thus be non-rotatable; and a locking device for locking the platform in said raised position while allowing free rotation of the platform in said raised position.

2. A golf practice device according to claim 1, wherein said bearing support comprises a pillar and a tube, said pillar being vertically displaceable and rotatably arranged in said tube, and a plate, said tube being fixed to said plate which is disposed to rest on the ground or other support.

3. A golf practice device according to claim 1, wherein the lifting device for raising the platform from the ground comprises a lifting roller attached to a leg which is pivotable over an arch for raising the platform from the ground.

4. A golf practice device according to claim 3, wherein the lifting device further comprises an operating shaft carrying said lifting roller and said leg, said operating shaft being operated by a stick.

5. A golf practice device according to claim 1, wherein the platform further is provided with retractable support members for carrying the platform at one border thereof for supporting the platform, in cooperation with said frame, in an essentially horizontal position.

6. A golf practice device according to claim 5, wherein the operating shaft is provided with means for moving said retractable support members from a rest position to an extended position for supporting the platform in the essentially horizontal position, and for moving said retractable support members back to said rest position.

* * * * *